US010352333B2

(12) United States Patent
Okada et al.

(10) Patent No.: US 10,352,333 B2
(45) Date of Patent: Jul. 16, 2019

(54) CONTAINER-INTERIOR DRYING DEVICE AND CONTAINER-INTERIOR DRYING METHOD

(71) Applicant: TOYO SEIKAN CO., LTD., Tokyo (JP)

(72) Inventors: Yoshiaki Okada, Yokohama (JP); Tomoyuki Miyazaki, Yokohama (JP); Keisuke Nyuu, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 198 days.

(21) Appl. No.: 15/613,524

(22) Filed: Jun. 5, 2017

(65) Prior Publication Data

US 2017/0268538 A1 Sep. 21, 2017

Related U.S. Application Data

(63) Continuation of application No. PCT/JP2015/080364, filed on Oct. 28, 2015.

(30) Foreign Application Priority Data

Dec. 8, 2014 (JP) ..... 2014-247881

(51) Int. Cl.
*B08B 9/08* (2006.01)
*F04F 5/24* (2006.01)
(Continued)

(52) U.S. Cl.
CPC ..... *F04F 5/24* (2013.01); *B05B 7/0823* (2013.01); *B05D 3/04* (2013.01); *B08B 9/0813* (2013.01);
(Continued)

(58) Field of Classification Search
CPC ..... B08B 9/08; B05B 9/0813
(Continued)

(56) References Cited

U.S. PATENT DOCUMENTS 2,240,364 A * 4/1941 Kimball ..... B08B 9/0813 118/315
2,509,396 A 5/1950 Mayer
(Continued)

FOREIGN PATENT DOCUMENTS

CN 203685712 U 7/2014
FR 2645951 A1 10/1990
(Continued)

OTHER PUBLICATIONS

International Search Report dated Dec. 8, 2015, issued in counterpart International Application No. PCT/JP2015/080364 (2 pages).

*Primary Examiner* — Robert A Hopkins
(74) *Attorney, Agent, or Firm* — Westerman, Hattori, Daniels & Adrian, LLP

(57) ABSTRACT

Provided are a container-interior drying device and a container-interior drying method capable of shortening drying time and improving the efficiency in an entire filling line without causing container deformation, the device having a simple configuration and requiring little space for installation. The device includes a gas ejector nozzle (110) capable of being inserted into an interior of a container through an opening of the container, a suction mechanism (120) capable of facing the opening of the container, and a gas supply unit (130) configured to supply the gas ejector nozzle (110) with gas, wherein gas is ejected into the interior of the container from the gas ejector nozzle (110), and the suction mechanism (120) positioned so as to face the opening of the container sucks out gas through the opening of the container.

6 Claims, 3 Drawing Sheets

(51) Int. Cl.

| | |
|---|---|
| ***B05D 3/04*** | (2006.01) |
| ***F26B 9/00*** | (2006.01) |
| ***B05B 7/08*** | (2006.01) |
| ***F26B 21/00*** | (2006.01) |
| *B05C 9/12* | (2006.01) |

(52) U.S. Cl.
CPC ..... *F26B 9/00* (2013.01); *F26B 21/006* (2013.01); *B05C 9/12* (2013.01)

(58) Field of Classification Search
USPC ..... 34/104
See application file for complete search history.

(56) References Cited

U.S. PATENT DOCUMENTS

| | | | |
|---|---|---|---|
| 4,987,001 | A | 1/1991 | Knobbe et al. |
| 5,173,325 | A | 12/1992 | Knobbe et al. |
| 6,345,452 | B1 | 2/2002 | Feuilloley et al. |
| 2012/0312329 | A1 | 12/2012 | David et al. |

FOREIGN PATENT DOCUMENTS

| | | | |
|---|---|---|---|
| GB | 123769 | A | 10/1919 |
| GB | 2272273 | A | 5/1994 |
| JP | S54-117546 | A | 9/1979 |
| JP | S58-51961 | A | 3/1983 |
| JP | 59-212677 | A | 12/1984 |
| JP | 2-153846 | A | 6/1990 |
| JP | H02-233160 | A | 9/1990 |
| JP | 4-184000 | A | 6/1992 |
| JP | 7-52555 | Y2 | 11/1995 |
| JP | H09-103739 | A | 4/1997 |
| JP | 2000-018822 | A | 1/2000 |
| JP | 2002-308231 | A | 10/2002 |
| JP | 3389111 | B2 | 3/2003 |
| JP | 2005-118683 | A | 5/2005 |
| JP | 2006-291941 | A | 10/2006 |
| KR | 10-2010-0013678 | A | 2/2010 |

* cited by examiner

CONTAINER-INTERIOR DRYING DEVICE AND CONTAINER-INTERIOR DRYING METHOD

TECHNICAL FIELD

The present invention relates to a container-interior drying device and a container-interior drying method for drying an inner wall surface of a container.

BACKGROUND ART

In general, plastic containers, which are formed easily and manufactured at lower costs, are widely used for various applications. However, putting viscous contents such as mayonnaise-like food within a plastic container causes the contents to easily stick on the inner wall surface of the container, resulting in a failure of using up the contents without leaving the contents within the container.

In recent years, coating agents for improving the slipping down of contents have been developed. It is known that applying such a coating agent on the inner wall surface of the container improves the slip characteristic of the inner wall surface of the container, allowing contents within the container to be used up easily.

In this regard, a possible approach to applying the coating agent uniformly on the inner wall surface of the container is to insert a nozzle as disclosed in Patent Literature 1 into the interior of the container and eject the coating agent while rotating the container.

CITATION LIST

Patent Literature

Patent Literature 1: Japanese Patent Application Publication No. 2005-118683

Patent Literature 2: Japanese Patent Application Publication No. H4-184000

Patent Literature 3: Japanese Patent Application Publication No. 2006-291941

SUMMARY OF INVENTION

Technical Problem

In ejecting and applying a coating agent to the interior of the container, as mentioned above, a solution of the coating agent containing a high-volatile solvent is sprayed. To fully volatilize and dry the solvent and fix the coating agent on the inner wall surface of the container, applying high-temperature heat to the container with an oven is typically done.

This method, however, requires a large scale oven to improve the efficiency in an entire filling line, and unfortunately, this requires large investment and large space for installing equipment.

In addition, a container, such as a plastic container, composed of a resin having a low melting point can cause an undesired deformation of the container depending on temperatures of the oven, and then lowering the oven temperature can cause a prolongation of the drying time and thus a decrease in the efficiency of the entire filling line.

Further, although another possible approach is to eject dry gas at the opening of the container toward the interior of the container to volatilize and dry the solvent, a container that needs applying a coating agent typically has a small opening, which does not allow for sufficient circulation of the gas, inevitably resulting in a prolongation of the drying time.

The present invention solves the above problems, and the object thereof is to provide a container-interior drying device and a container-interior drying method capable of shortening the drying time and improving the efficiency in the entire filling line without causing container deformation, the device having a simple configuration and requiring little space for installation.

Solution to Problem

A container-interior drying device according to the present invention is a device for drying an inner wall surface of a container and solves the above-mentioned problems by including a gas ejector nozzle capable of being inserted into an interior of the container through an opening of the container, a suction mechanism capable of facing the opening of the container, and a gas supply unit configured to supply the gas ejector nozzle with gas.

In addition, a container-interior drying method according to the present invention is a method for drying an inner wall surface of a container and solves the above-mentioned problems by inserting a gas ejector nozzle into an interior of the container through an opening of the container, and ejecting gas from the gas ejector nozzle into the interior of the container and sucking out gas through the opening of the container by a suction mechanism positioned so as to face the opening of the container.

Advantageous Effects of Invention

A container-interior drying device according to claim 1 includes a gas ejector nozzle capable of being inserted into an interior of the container through an opening of the container, a suction mechanism capable of facing the opening of the container, and a gas supply unit configured to supply the gas ejector nozzle with gas. This facilitates blowing of dry air or the like into the interior of the container and enables suction of air within the container through the opening of the container by the suction mechanism, allowing gas within the container to be reliably sucked out through the opening of the container to allow gas within the container to fully circulate, even if a large amount of gas is ejected within the container.

In consequence, the container-interior drying device, while having a simple configuration and requiring little space for installation, shortens drying time without causing container deformation, improving the efficiency in an entire filling line.

Further, the container-interior drying device allows the gas ejector nozzle also to blow gas to the inner wall surface of the container, further facilitating the drying of the interior of the container.

In the configuration according to claim 2, the suction mechanism is formed of a gas flow amplifying unit, the gas flow amplifying unit includes a gas supply part and a gas flow amplification path that has a suction inlet and an ejection outlet, and the suction inlet is positioned so as to face the opening of the container. This configuration enables suction of air within the container from the suction inlet using compressed gas, eliminating the need for equipment such as a vacuum apparatus, achieving a simpler configuration of the container-interior drying device and a smaller space for installing it.

In the configuration according to claim 3, the gas supply unit is configured to supply the gas supply part of the gas flow amplifying unit with gas. This configuration eliminates the need for an independent driving source for sucking out air within the container, achieving a still smaller space for installing the container-interior drying device.

In the configuration according to claim 4, the gas ejector nozzle is provided through the gas flow amplification path of the gas flow amplifying unit. This configuration positions the suction inlet of the gas flow amplifying unit so as to allow it to cover the entire opening of the container, enabling suction of a larger amount of gas.

In the configuration according to claim 5, the container-interior drying device further includes means for moving the gas ejector nozzle. This configuration allows optional insertion and extraction of the gas ejector nozzle without moving the container, facilitating incorporation of the container-interior drying device into existing equipment including a container-conveyor line.

Further, this configuration allows gas to be ejected from the gas ejector nozzle while the gas ejector nozzle is moved within the container, enabling a more reliable circulation of gas within the container.

A container-interior drying method according to claim 6 includes inserting a gas ejector nozzle into an interior of the container through an opening of the container, and ejecting gas from the gas ejector nozzle into the interior of the container and sucking out gas through the opening of the container by a suction mechanism positioned so as to face the opening of the container. This configuration allows gas within the container to be reliably discharged to an exterior of the container to allow gas within the container to fully circulate, even if a large amount of gas is ejected within the container.

In consequence, the container-interior drying method, while enabling equipment to have a simple configuration and further to require little space for installing the equipment, shortens a drying time without causing container deformation, improving the efficiency in an entire filling line.

Further, the container-interior drying method allows blowing of gas to the inner wall surface of the container by the gas ejector nozzle, further facilitating the drying of the interior of the container.

In the configuration according to claim 7, the suction mechanism is formed of a gas flow amplifying unit including a gas supply part and a gas flow amplification path that has a suction inlet and an ejection outlet, and the container-interior drying method includes supplying the gas ejector nozzle with gas to eject gas into the interior of the container and supplying the gas supply part of the gas flow amplifying unit with gas to suck out gas through the opening of the container. This configuration eliminates the need for equipment such as a vacuum apparatus, enabling equipment to have a simpler configuration and to require little space for installing the equipment.

REFERENCE SIGNS LIST

Figure 1:
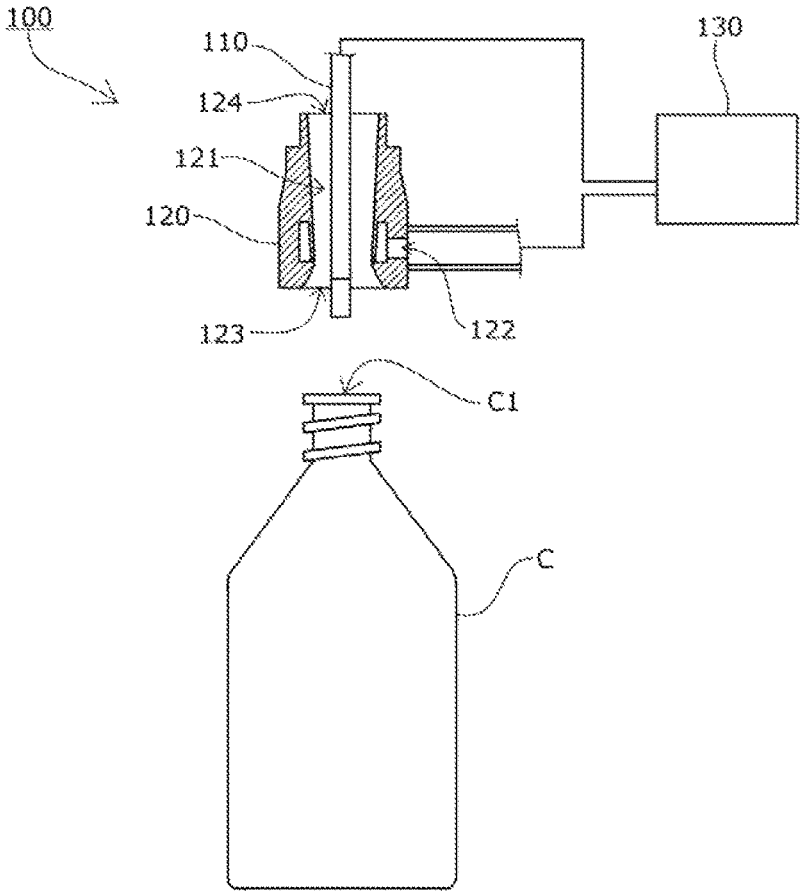
FIG. 1 is a schematic illustration of a container-interior drying device according to an embodiment of the present invention.

100 Container-interior drying device
110 Gas ejector nozzle
120 Gas flow amplifying unit (suction mechanism)
121 Gas flow amplification path
122 Gas supply part
123 Suction inlet
124 Ejection outlet
130 Gas supply unit
200 Coating device
210 Spray gun
211 Spray nozzle
220 Vertical drive mechanism
230 Rotary drive mechanism
C Container
C1 Opening
L Coating agent
H Container holding means

DESCRIPTION OF EMBODIMENT

Figure 2:
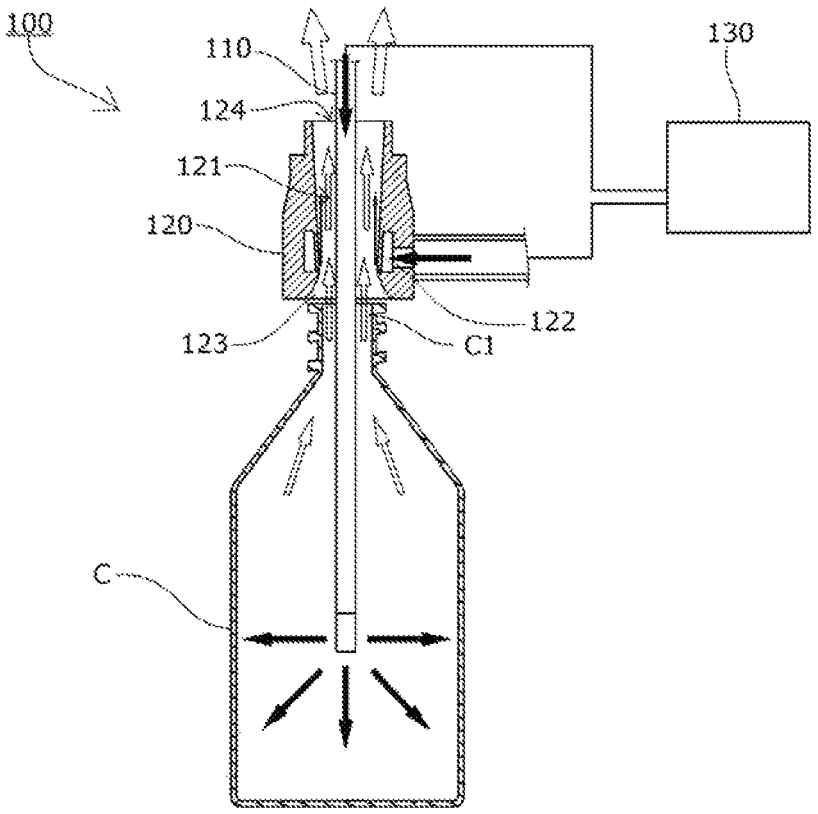
FIG. 2 is a schematic illustration of the container-interior drying device, in operation, according to the embodiment of the present invention.

As illustrated in FIGS. 1 and 2, a container-interior drying device 100 according to an embodiment of the present invention includes a gas ejector nozzle 110, a gas flow amplifying unit 120 that serves as a suction mechanism, and a gas supply unit 130 that supplies the gas ejector nozzle 110 and the gas flow amplifying unit 120 with gas, the gas ejector nozzle 110 being capable of being inserted into an interior of a container C through an opening C1 of the container C, the gas flow amplifying unit 120 being capable of facing a top of the opening C1 of the container C.

The gas ejector nozzle 110 is configured to move upward and downward by a moving means (not shown) and to eject gas from its lower end tip.

The gas flow amplifying unit 120, which includes a gas supply part 122 and a gas flow amplification path 121 that has a suction inlet 123 at the bottom and an ejection outlet 124 at the top, has the function of an amplifying mechanism as disclosed in Patent Literature 2, 3 or the like. The gas flow amplifying unit 120 ejects gas supplied to the gas supply part 122 at high speed toward the ejection outlet 124 along an inner periphery of the gas flow amplification path 121, and resultantly, sucks out gas from the suction inlet 123 to eject high-speed, high-pressure gas from the ejection outlet 124.

Further, the gas flow amplifying unit 120 is configured to move upward and downward by a moving means (not shown) independent of the means for moving the gas ejector nozzle 110. The gas flow amplifying unit 120 is positioned so as to allow the suction inlet 123 to face the top of the opening C1 of the container C and the gas ejector nozzle 110 to be disposed through the gas flow amplification path 121.

It is noted that the gas flow amplifying unit 120 may be disposed in a fixed manner, so as not to move upward or downward.

The gas supply unit 130, which supplies gas to the gas ejector nozzle 110 and the gas supply part 122 of the gas flow amplifying unit 120, may, for example, be composed of a gas flow path alone that is connected to a compressed gas supply source in a place where the container-interior drying device 100 according to the present embodiment is installed. Alternatively, the gas supply unit 130 may then include a regulating mechanism for attaining a pressure and flow rate appropriate to each of the gas ejector nozzle 110 and the gas supply part 122.

Further, any other-principle based suction mechanism that can suck out gas in the interior through the opening C1 of the container C can be used instead of the gas flow amplifying unit 120.

Now there will be described an embodiment of a container-interior drying method by means of the container-interior drying device 100 as mentioned.

Figure 3:
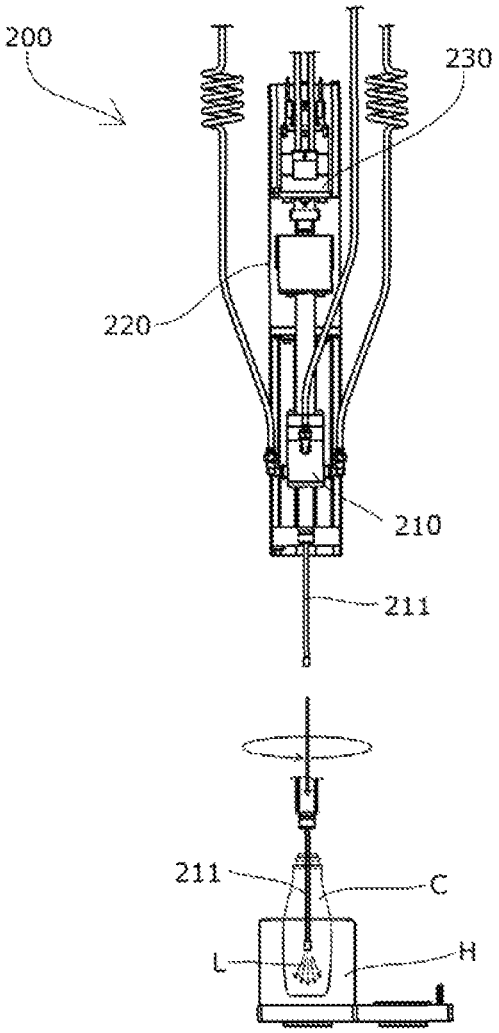
FIG. 3 is a reference illustration of a coating device.

Spraying a coating agent containing a high-volatile solvent, which is to be dried, on an inner wall surface of the container C is done by means of, for example, a coating device 200 as illustrated in FIG. 3.

The container C held by a container holding means H is moved to a position beneath a spray gun 210 and is stopped at the position. Then the spray gun 210 is moved down by a vertical drive mechanism 220 to insert a spray nozzle 211 into the interior of the container C.

At the timing when the spray nozzle 211 has reached the lowest level, the spray gun 210 is rotated by a rotary drive mechanism 230. Concurrently, a coating agent L is ejected from an end tip of the spray nozzle 211. Then, while the spray gun 210 is moved up, the coating agent L is ejected from the end tip of the spray nozzle 211. This process allows the coating agent L to be sprayed uniformly on the inner wall surface of the container C.

While having been held by the container holding means H, the container C that has undergone the application of the coating agent L is moved to a position beneath the gas flow amplifying unit 120 of the container-interior drying device 100 and is stopped at the position as illustrated in FIG. 1.

Next, the gas flow amplifying unit 120 and the gas ejector nozzle 110 are moved down. As illustrated in FIG. 2, the gas flow amplifying unit 120 is stopped at a position that allows the suction inlet 123 of the gas flow amplification path 121 to be spaced slightly from the opening C1 of the container C, whereas the gas ejector nozzle 110 is further moved down to enter the interior of the container C.

Then, dry air is ejected from the gas ejector nozzle 110 and the gas supply part 122 of the gas flow amplifying unit 120 is supplied with gas, causing dry air within the container C to be sucked.

In this regard, the space between the suction inlet 123 and the opening C1 of the container C is desirably as narrow as possible to the extent that eliminates deformation or adhesion to the suction inlet 123 of the container C per se due to negative pressure.

The ejecting of dry air from the gas ejector nozzle 110 and the supply of gas to the gas supply part 122 of the gas flow amplifying unit 120 may be started concurrently with the starting of or after the completion of the moving down.

Alternatively, dry air may be ejected from the gas ejector nozzle 110 while the gas ejector nozzle 110 is moved up and down or rotated.

For this operation, driving mechanisms similar to the vertical drive mechanism 220 and the rotary drive mechanism 230 in the above coating device 200 can be used.

Alternatively, the gas ejector nozzle 110 and the gas flow amplifying unit 120 may be provided integrally with the spray nozzle 211 of the above coating device 200 to carry out the drying process by the gas ejector nozzle 110 and the gas flow amplifying unit 120, as part of the process of applying the coating agent L, after the coating process with the spray nozzle 211.

Further, after the coating process, feeding of the coating agent L to the spray gun 210 may be stopped to allow the spray nozzle 211, which would then eject dry air alone, to function as the gas ejector nozzle 110.

Although, the container-interior drying device 100 in the above embodiment is positioned so as to point the gas ejector nozzle 110 in the vertical direction, the container-interior drying device 100 may be installed in any position, such as being positioned so as to point the gas ejector nozzle 110 in the horizontal direction.

Further, although the container-interior drying device and the container-interior drying method in the above embodiment are described as drying the coating agent applied on the container with dry air, the container-interior drying device and the container-interior drying method may be used to dry other liquids, such as rinse water remaining after a cleaning process.

Further, the container-interior drying device and the container-interior drying method may be used for other applications, or to exert heating or cooling effect according to the gas used for the ejection or to exert other effects by blowing a special gas other than air.

The invention claimed is:

1. A container-interior drying device for drying an inner wall surface of a container, the device comprising:

a gas ejector nozzle capable of being inserted into an interior of the container through an opening of the container;

a suction mechanism capable of facing the opening of the container;

a gas supply unit configured to supply the gas ejector nozzle with gas; and means for moving the gas ejector nozzle.

2. The container-interior drying device according to claim 1, wherein the suction mechanism is formed of a gas flow amplifying unit, the gas flow amplifying unit includes a gas supply part and a gas flow amplification path that has a suction inlet and an ejection outlet, and the suction inlet is positioned so as to face the opening of the container.

3. The container-interior drying device according to claim 2, wherein the gas supply unit is configured to supply the gas supply part of the gas flow amplifying unit with gas.

4. A container-interior drying device for drying an inner wall surface of a container, the device comprising:

a gas ejector nozzle capable of being inserted into an interior of the container through an opening of the container;

a suction mechanism capable of facing the opening of the container; and a gas supply unit configured to supply the gas ejector nozzle with gas, wherein the suction mechanism is formed of a gas flow amplifying unit, the gas flow amplifying unit includes a gas supply part and a gas flow amplification path that has a suction inlet and an ejection outlet, and the suction inlet is positioned so as to face the opening of the container, and wherein the gas ejector nozzle is provided through the gas flow amplification path of the gas flow amplifying unit.

5. A container-interior drying method for drying an inner wall surface of a container, the method comprising:

inserting a gas ejector nozzle into an interior of the container through an opening of the container;

ejecting gas from the gas ejector nozzle into the interior of the container and sucking out gas through the opening of the container by a suction mechanism positioned so as to face the opening of the container; and moving the gas ejector nozzle.

6. The container-interior drying method according to claim 5, wherein the suction mechanism is formed of a gas flow amplifying unit including a gas supply part and a gas flow amplification path that has a suction inlet and an ejection outlet, and the method comprises supplying the gas ejector nozzle with gas to eject gas into the interior of the container and supplying the gas supply part of the gas flow amplifying unit with gas to suck out gas through the opening of the container.

* * * * *